US005452194A

United States Patent [19]

Phalen

[11] Patent Number: 5,452,194

[45] Date of Patent: Sep. 19, 1995

[54] CORDLESS TROUBLE LIGHTS WITH A CAGE SURROUNDING THE LIGHT SOURCE

[76] Inventor: John H. Phalen, 4303 Mark Avenue, Terrace, B.C., Canada, V8G3X9

[21] Appl. No.: 303,831

[22] Filed: Sep. 9, 1994

[51] Int. Cl.[6] ..... F21V 15/02

[52] U.S. Cl. ..... 362/376; 362/226; 362/400; 362/410; 362/431; 362/457

[58] Field of Search ..... 362/226, 376, 378, 382, 362/410, 414, 431, 457, 458, 109, 399, 400

[56] References Cited

U.S. PATENT DOCUMENTS

| | | | |
|---|---|---|---|
| 2,710,338 | 6/1955 | Svalgaard | 362/186 |
| 2,735,930 | 2/1956 | Weight | 362/378 |
| 4,774,647 | 9/1988 | Kovacik et al. | 362/378 |
| 5,278,740 | 1/1994 | Agnelli | 362/376 |

*Primary Examiner*—Ira S. Lazarus
*Assistant Examiner*—Alan B. Cariaso

[57] ABSTRACT

A cordless trouble light with a cage surrounding the light source comprising: a handle formed as a hollow generally cylindrical shaped member with an inboard end and an outboard end, the handle including a notch for placement of a switch, the inboard end including a light bulb socket with coupling devices, the outboard end consisting of an outlet ground plug with three prongs, an on/off switch system being positioned within the notch in the handle, three wires being operatively coupled to the switch, bulb socket, and outlet plug, the switch permitting electric flow to light source when in the on orientation; and a cage formed in a generally cylindrical configuration with a front segment and a rear segment, the rear segment being coupled to the inboard end of the handle, the front segment being rotatably affixed to the rear segment at one end, the segments being releasably coupled at the diametrically opposite edge, the segments consisting of a plurality of perpendicularly intersecting bars.

4 Claims, 3 Drawing Sheets

FIG. 5
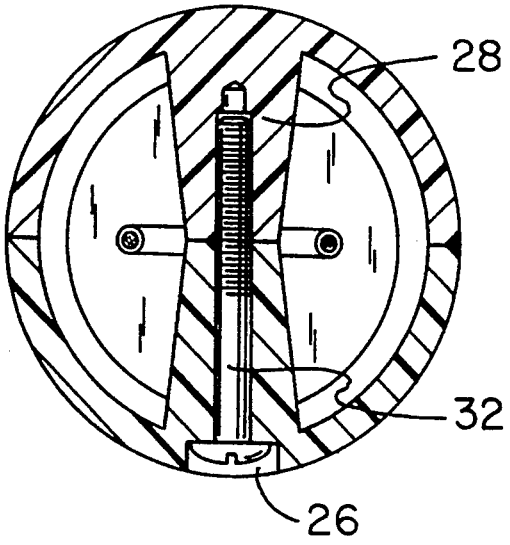
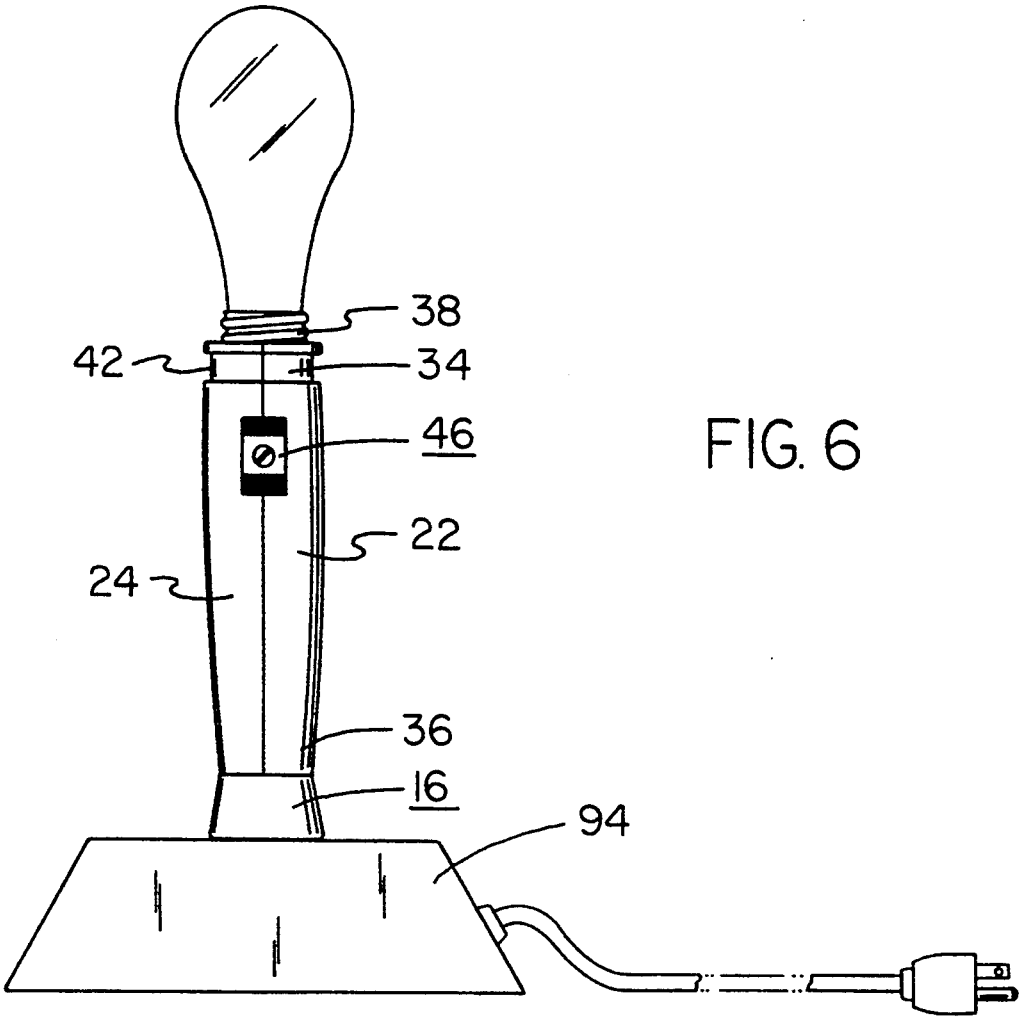
FIG. 6

CORDLESS TROUBLE LIGHTS WITH A CAGE SURROUNDING THE LIGHT SOURCE

BACKGROUND OF THE INVENTION

1. Field of the Invention

The present invention relates to cordless trouble lights with a cage surrounding the light source and more particularly pertains to conveniently storing and transporting the apparatus for illumination of varying locations without the burden of accommodating a long extension cord.

2. Description of the Prior Art

The use of trouble lights is known in the prior art. More specifically, trouble lights heretofore devised and utilized for the purpose of lighting various locations by operatively coupling the long flexible cord of the apparatus with an electrical source are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,154,511 to Veneskey a trouble-light with rotatable shield.

U.S. Pat. No. 5,072,352 to Rosenschein discloses a trouble lamp.

U.S. Pat. No. 5,257,172 to Erickson discloses a trouble light.

U.S. Pat. No. 4,458,304 to Imsdahl discloses a trouble light stand.

Lastly, U.S. Pat. Des. No. 335,359 to Grubb discloses a retractable emergency trouble light for motor vehicle.

In this respect, the cordless trouble lights with a cage surrounding the light source according to the present invention substantially departs from the conventional concepts and designs of the prior art, and in doing so provides an apparatus primarily developed for the purpose of conveniently storing and transporting the apparatus for illumination of varying locations without the burden of accommodating a long extension cord.

Therefore, it can be appreciated that there exists a continuing need for new and improved cordless trouble lights with a cage surrounding the light source which can be used for conveniently storing and transporting the apparatus for illumination of varying locations without the burden of accommodating a long extension cord. In this regard, the present invention substantially fulfills this need.

SUMMARY OF THE INVENTION

In view of the foregoing disadvantages inherent in the known types of trouble lights now present in the prior art, the present invention provides improved cordless trouble lights with a cage surrounding the light source. As such, the general purpose of the present invention, which will be described subsequently in greater detail, is to provide new and improved cordless trouble lights with a cage surrounding the light source and method which has all the advantages of the prior art and none of the disadvantages.

To attain this, the present invention essentially comprises a new and improved cordless trouble light with a cage surrounding the light source comprising, in combination: a handle formed of two long semi spherical shaped components comprising a hollow generally cylindrical shaped member in the assembled orientation, a first semi spherical shaped component including two screw apertures extending therethrough, a second semi spherical shaped component including two projections each having a bore with internal screw threads, each of the components including a rectangular notch contiguous with their adjacent edges for placement of a switch, two screws couple the semi spherical shaped components, the handle having an inboard end and an outboard end, the outer diameter of the center point of the handle being larger than that of each end with a gradually decreasing diameter therebetween, the furthest extent of the inboard end including a hollow generally cylindrical shaped light bulb socket with a plurality of internal screw threads, the outboard portion of the socket including coupling means, the inboard end including a recessed groove around its entire circumference positioned adjacent to the bulb socket, the furthest extent of the outboard end being fabricated as a solid piece with two metal connectors positioned therethrough, each end of the connectors including coupling means; an on/off switch system, the system including a generally rectangular shaped switch with an outboard portion and an inboard portion, the inboard portion being positioned within the notches in the handle, the outboard portion being positioned outside the handle and adapted to easily slide into the on or off position upon application of pressure by the user, the inboard portion including coupling means for attachment of electrical wires, three wires being positioned within the hollow interior of the handle, a first wire being coupled to the switch and bulb socket, a second wire being coupled to the bulb socket and a metal connector in the outboard end of the handle, a third wire being coupled to the switch and a metal connector in the outboard end of the handle, when in the on position the switch adapted to permit the flow of electrical current through the apparatus thereby illuminating an operatively coupled light bulb; an outlet plug formed in a solid generally cylindrical configuration with two flat ends, the plug having an inboard end and an outboard end, the plug including three prongs positioned in a standard triangular ground configuration, the inboard end of the prongs being flush with the end of the inboard end of the plug and affixed to the outboard end of the handle, two of the prongs being in contact with the metal connectors in the handle, the outboard end of the prongs extending beyond the outboard end of the plug and adapted to be coupled with a standard female ground configured electrical source; and a cage formed in a generally cylindrical configuration with a front segment and a rear segment, the rear segment being formed as a solid generally semi spherical shaped member with a rounded outboard end and a generally V-shaped inboard end terminating in a C-shaped band, the band adapted to be positioned around the recessed groove in the handle with the free ends of the band being releasable coupled together with a nut and bolt, the front segment of the cage having an inboard region, an outboard region and a central region therebetween, the front segment being affixed with a rotatable hinge to the rear segment at one edge and releasably coupled thereto at the diametrically opposite edge, the central region consisting of a plurality of curved perpendicularly intersecting bars, the outboard region consisting of one or more curved inverted U-shaped bars extending from the central region, the furthest extent of the outboard region including a hook extending therefrom, the inboard region consisting of a plurality of linear bars extending inwardly from the central region, the cage adapted to protected a light bulb coupled within the apparatus.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved cordless trouble lights with a cage surrounding the light source which have all the advantages of the prior art trouble lights and none of the disadvantages.

It is another object of the present invention to provide new and improved cordless trouble lights with a cage surrounding the light source which may be easily and efficiently manufactured and marketed.

It is further object of the present invention to provide new and improved cordless trouble lights with a cage surrounding the light source which are of durable and reliable constructions.

An even further object of the present invention is to provide new and improved cordless trouble lights with a cage surrounding the light source which are susceptible of a low cost of manufacture with regard to both materials and labor, and which accordingly are then susceptible of low prices of sale to the consuming public, thereby making such cordless trouble lights with a cage surrounding the light source economically available to the buying public.

Still yet another object of the present invention is to provide new and improved cordless trouble lights with a cage surrounding the light source which provide in the apparatuses and methods of the prior art some of the advantages thereof, while simultaneously overcoming some of the disadvantages normally associated therewith.

Still another object of the present invention is to conveniently store and transport the apparatus for illumination of varying locations without the burden of accommodating a long extension cord.

Lastly, it is an object of the present invention to provide new and improved cordless trouble lights with a cage surrounding the light source comprising: a handle formed as a hollow generally cylindrical shaped member with an inboard end and an outboard end, the handle including a notch for placement of a switch, the inboard end including a light bulb socket with coupling devices, the outboard end consisting of an outlet ground plug with three prongs, an on/off switch system being positioned within the notch in the handle, three wires being operatively coupled to the switch, bulb socket, and outlet plug, the switch permitting electric flow to light source when in the on orientation; and a cage formed in a generally cylindrical configuration with a front segment and a rear segment, the rear segment being coupled to the inboard end of the handle, the front segment being rotatably affixed to the rear segment at one end, the segments being releasably coupled at the diametrically opposite edge, the segments consisting of a plurality of perpendicularly intersecting bars.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view of the apparatus taken along line 5—5 of FIG. 2.

FIG. 6 is a perspective view of an alternative embodiment of the apparatus.

The same reference numerals refer to the same parts through the various Figures.

DESCRIPTION OF THE PREFERRED EMBODIMENT

Figure 1:
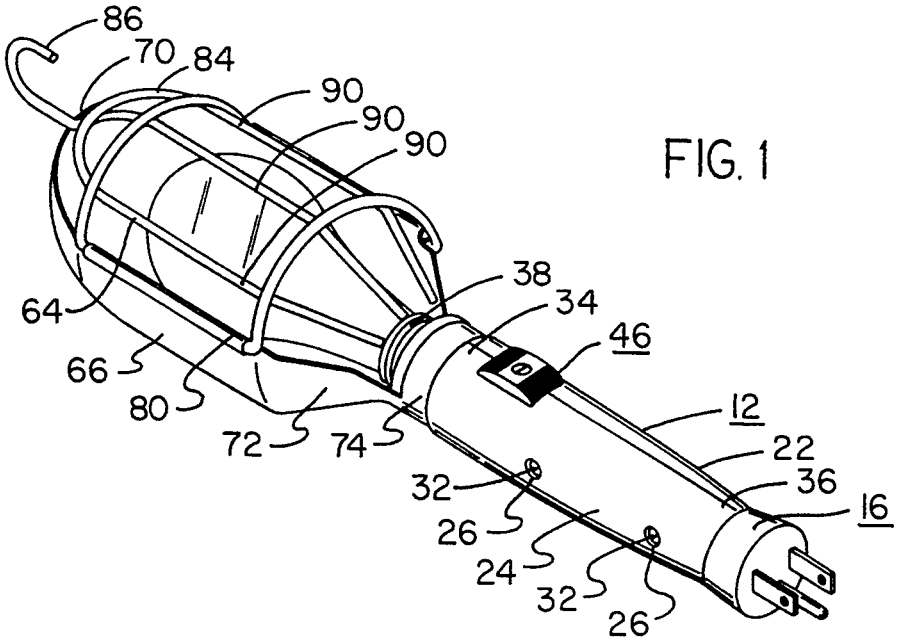
FIG. 1 is a perspective view of the preferred embodiment of the cordless trouble light with a cage surrounding the light source constructed in accordance with the principles of the present invention.

With reference now to the drawings, and in particular to FIG. 1 thereof, the preferred embodiment of the new and improved cordless trouble lights with a cage surrounding the light source embodying the principles and concepts of the present invention and generally designated by the reference numeral 10 will be described.

The present invention, the cordless trouble light with a cage surrounding the light source 10 is comprised of a plurality of components. Such components in their broadest context include a handle 12, an on/off switch system 14, an outlet plug 16 and a cage 18.

Figure 2:
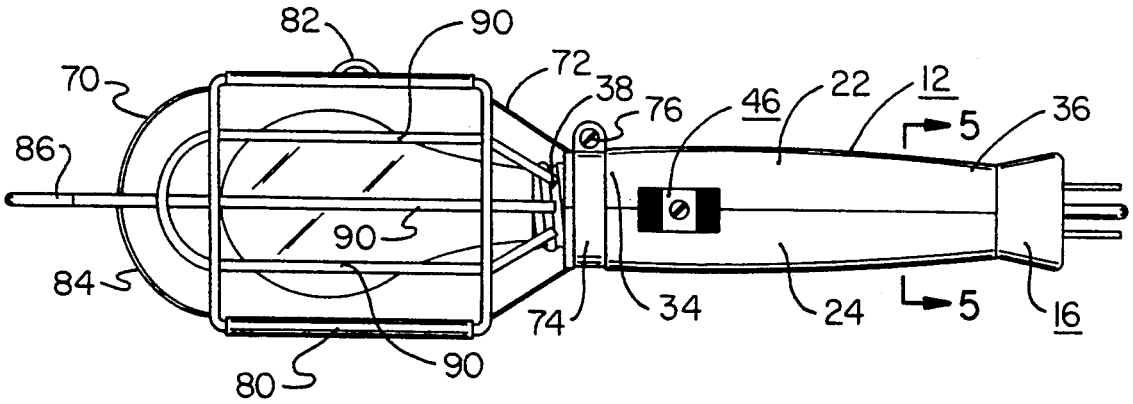
FIG. 2 is a front perspective view of the apparatus shown in FIG. 1.
Figure 3:
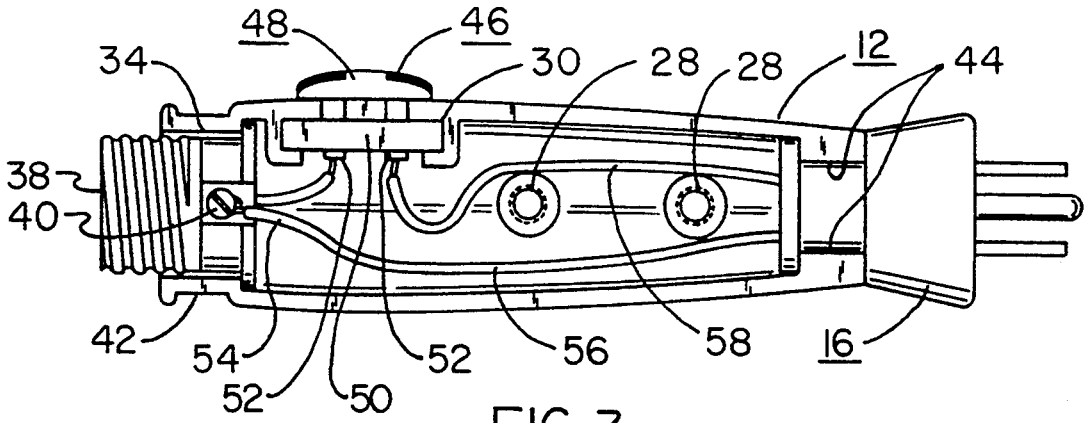
FIG. 3 is a cross sectional view of the apparatus taken along the center of the handle and plug.

More specifically, the handle 12 is formed of two long semi spherical shaped components 22, 24. In the assembled orientation the two components form a hollow generally cylindrical shaped member. A first semi spherical shaped component includes two screw apertures 26 extending therethrough. A second semi spherical shaped component includes two projections 28 with each having a bore with internal screw threads. Each of the components includes a rectangular notch 30 which is contiguous with their respective adjacent edges. The notches are for placement of a switch. Two screws 32 couple the semi spherical shaped components together. The split configuration of the handle permits easy assembly and repair of the apparatus. Note FIGS. 2 and 3.

The handle has an inboard end 34 and an outboard end 36. The outer diameter of the center point of the handle is larger than that of each end, with a gradually decreasing diameter therebetween. The shape of the handle allows for easy gripping by the user. The furthest extent of the inboard end includes a hollow generally cylindrical shaped light bulb socket 38 with a plurality of internal screw threads. The socket permits placement of a standard sized light bulb therein. The outboard portion of the socket includes coupling means 40. The coupling means permit easy affixation of electrical wires. The inboard end includes a recessed groove 42 around its entire circumference. The groove is positioned adjacent to the bulb socket. The furthest extent of the outboard end is fabricated as a solid piece with two metal connectors 44 positioned therethrough. Each end of the connectors includes coupling means affixed thereto to permit easy affixation of electrical wires. Note FIG. 3.

An on/off switch system 14 includes a generally rectangular shaped switch 46 with an outboard portion 48 and an inboard portion 50. The inboard portion 50 is positioned within the notches in the handle. The outboard portion is positioned outside the handle and is adapted to easily slide into the on or off position upon application of pressure by the user. The inboard portion includes coupling means 52 for attachment of electrical wires. The positioning of the switch within the notches allows for easy repair and replacement when necessary. The sliding outboard portion of the switch permits one handed operation of the apparatus by the user. Note FIGS. 1 and 2.

Three wires 54, 56, 58 are positioned within the hollow interior of the handle. A first wire 54 is coupled to the switch and bulb socket. A second wire 56 is coupled to the bulb socket and a metal connector in the outboard end of the handle. A third wire 58 is coupled to the switch and a metal connector in the outboard end of the handle. The wires are safely housed within the handle to prevent damage thereto. When in the on position the switch is adapted to permit the free flow of electrical current through the apparatus thereby illuminating an operatively coupled light bulb. See FIGS. 1 and 3.

An outlet plug 16 is formed in a solid generally cylindrical configuration with two flat ends. The plug has an inboard end and an outboard end. The plug includes three prongs 60 which are positioned in a standard triangular ground configuration. Two of the prongs are operatively coupled with the electrical source, with the ground prong being coupled with a grounding source. The inboard end of the prongs is flush with the inboard end of the plug. The plug is affixed to the outboard end of the handle. Two of the prongs are in contact with the metal connectors in the handle. The outboard end of the prongs extends beyond the outboard end of the plug and is adapted to be coupled with a standard female ground configured electrical source in the operative orientation. The typical user will plug the apparatus into an extension cord female plug. The compact structure of the apparatus permits the user to carry it from location to location utilizing a previously unraveled extension cord. Note FIG. 2.

Figure 4:
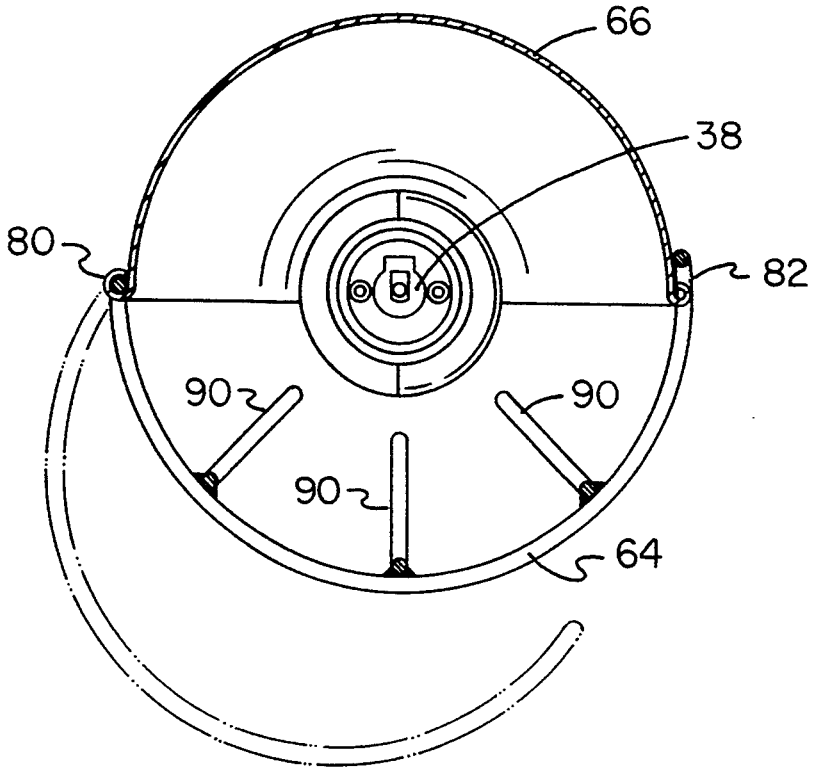
FIG. 4 is a cross sectional view of the apparatus taken radially through the cage and illustrating the rotatably attached cage door.

A cage 18 is formed in a generally cylindrical configuration with a front segment 64 and a rear segment 66. The rear segment is formed as a solid, generally semi spherical shaped member with a rounded outboard end 70 and a generally V-shaped inboard end 72. The inboard end terminates in a C-shaped band 74. The band is adapted to be positioned around the recessed groove in the handle. The free ends of the band are releasable coupled together with a nut and bolt 76. The sturdy construction of the band insures stable mounting of the cage. Note FIGS. 2 and 4.

The front segment of the cage has an inboard region, an outboard region and a central region therebetween. The front segment is affixed with a rotatable hinge 80 to the rear segment at one edge. The segments are releasably coupled 82 to each other at the diametrically opposite edge. This configuration allows the user easy access to a light bulb mounted in the apparatus. The central region consists of a plurality of curved perpendicularly intersecting bars. The outboard region consists of one or more curved inverted U-shaped bars 84 which extend from the central region. The furthest extent of the outboard region includes a hook 86 which extends therefrom. The inboard region consists of a plurality of linear bars 90 which extend inwardly from the central region. During use portable lights are often inadvertently banged against walls and other objects. The cage is adapted to protect a light bulb from breakage when such events occur. Note FIGS. 1, 2 and 4.

An alternative embodiment of the apparatus is shown in FIG. 6. In this embodiment the cage is removed from the apparatus. A lamp base 94 is also included. The lamp base includes a standard female ground electrical plug to permit coupling of the apparatus therein in a vertical orientation. This permits stationary use of the apparatus thereby enhancing its utility. Note FIG. 6.

Conventional trouble lights have long extension cords, usually at least twenty feet in length. These cords are not only bulky and cumbersome, but can also cause serious injury if inadvertently severed. Since most people already own conventional extension cords, the long cord attached to conventional trouble lights is unnecessarily redundant.

The cordless trouble light with a cage surrounding the light source has the utility of a conventional trouble light without the burden of carrying around a cumbersome extension cord. The apparatus is less expensive to manufacture and can be easily toted around on a users belt or work apron. The compact apparatus can be easily stored in a tool box or plugged directly into a wall outlet. When using other power tools in the vicinity of a particular work area, the light weight apparatus can be easily plugged into a multiple outlet extension cord or cube tap. The cordless trouble light with a cage surrounding the light source would be a useful device for anyone requiring a portable light source.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved cordless trouble light with a cage surrounding a light source comprising, in combination:

a handle formed of two long semicircular shaped components comprising a hollow generally cylindrical shaped member, a first semicircular shaped component including two screw apertures extending therethrough, a second semicircular shaped component including two projections each having a bore with internal screw threads, each of the components including a rectangular notch contiguous with their adjacent edges for placement of a switch, two screws couple the semicircular shaped components, the handle having an inboard end, an outboard end and a central region therebetween, the diameter of the central region of the handle being larger than that of each end with a gradually decreasing diameter therebetween, the inboard end including a hollow generally cylindrical shaped light bulb socket with a plurality of internal screw threads, the socket including coupling means, the inboard end including a recessed groove around its entire circumference positioned adjacent to the bulb socket, the outboard end being fabricated as a solid piece with two metal connectors positioned therethrough, each end of the connectors including coupling means;

an on/off switch system, the system including a generally rectangular shaped switch with an outboard portion and an inboard portion, the inboard portion of the switch being positioned outside the handle, the outboard portion being slidable into an on position or an off position upon application of pressure by a user, the inboard portion including coupling means for attachment of electrical wires, three wires being positioned within the hollow interior of the handle, a first wire being coupled to the switch and bulb socket, a second wire being coupled to the bulb socket and a metal connector in the outboard end of the handle, a third wire being coupled to the switch and a metal connector in the outboard end of the handle, when in the on position the switch adapted to permit the flow of electrical current through the apparatus thereby illuminating an operatively coupled light bulb;

an outlet plug formed in a solid generally cylindrical configuration with an inboard end and an outboard end, the plug including three prongs positioned in a standard triangular ground configuration and extending from the outboard end of the plug, the inboard end of the plug being affixed to the outboard end of the handle, the prongs being operatively coupled to the wires of the on/off system, the plug adapted to be coupled with a standard female ground configured electrical source;

a cage formed in a generally cylindrical configuration with a front segment and a rear segment, the rear segment being formed as a solid generally semicircular shaped member with a rounded outboard end and a generally V-shaped inboard end terminating in a C-shaped band having two free ends, the band adapted to be positioned around the recessed groove in the handle with the free ends of the band being releasably coupled together with a nut and bolt, the front segment of the cage having an inboard region, an outboard region and a central region therebetween, the front segment having a first edge including a rotatable hinge and a second edge including coupling means, the hinge being rotatably coupled to the rear segment and the coupling means being releasably coupled to the rear segment, the central region consisting of a plurality of curved perpendicularly intersecting bars, the outboard region consisting of one or more curved inverted U-shaped bars extending from the central region, the outboard region including a hook extending therefrom, the inboard region consisting of a plurality of linear bars extending inwardly from the central region, the cage adapted to protected a light bulb coupled within the apparatus; and a lamp base formed as a generally rectangular shaped box with an upper surface, a lower surface and four side walls therebetween, the upper surface permitting the operative coupling of the outlet plug of the apparatus therein, the handle being positioned in a vertical orientation, the base including an electrical extension cord operatively coupled to the outlet plug of the apparatus, the cord including a standard male ground electrical plug to permit coupling to a standard female ground configured electrical source in the operative orientation.

2. A cordless trouble light with a cage surrounding a light source comprising:

a handle formed as a hollow generally cylindrical shaped member with an inboard end and an outboard end, the handle including a notch for placement of a switch, the inboard end including a light bulb socket with coupling devices, the outboard end consisting of an outlet ground plug with three prongs, an on/off switch system being positioned within the notch in the handle, three wires being operatively coupled to the switch, bulb socket, and outlet plug, the switch adapted to permit the flow of electrical current through the apparatus thereby illuminating an operatively coupled light bulb;

a cage formed in a generally cylindrical configuration with a front segment and a rear segment, the rear segment being coupled to the inboard end of the handle, the front segment being rotatably affixed to the rear segment at one end, the segments being releasably coupled at another end, the segments consisting of a plurality of perpendicularly intersecting bars; and a lamp base formed as a generally rectangular shaped box with an upper surface, a lower surface and four side walls therebetween, the upper surface permitting the operative coupling of the outlet plug of the apparatus therein, the handle being positioned in a vertical orientation, the base including an electrical extension cord operatively coupled to the outlet plug of the apparatus, the cord including a standard male ground electrical plug to permit coupling to a standard female ground configured electrical source in the operative orientation.

3. The apparatus as set forth in claim 2 wherein the rear segment of the cage is formed as a solid generally semi spherical shaped member, the front segment consisting of a plurality of curved perpendicularly intersecting bars.

4. The apparatus as set forth in claim 2 wherein a plurality of light bulbs of varying illumination potential are included with the apparatus.

* * * * *